US007270090B2

(12) United States Patent
Surnilla

(10) Patent No.: US 7,270,090 B2
(45) Date of Patent: Sep. 18, 2007

(54) CONTROL SYSTEM FOR ENGINE COOLING

(75) Inventor: Gopichandra Surnilla, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 386 days.

(21) Appl. No.: 10/625,759

(22) Filed: Jul. 22, 2003

(65) Prior Publication Data

US 2005/0016472 A1 Jan. 27, 2005

(51) Int. Cl.
*F01P 7/00* (2006.01)

(52) U.S. Cl. ..... 123/41.02

(58) Field of Classification Search ..... 123/41.02, 123/41.44, 41.49, 41.47, 41.46
See application file for complete search history.

(56) References Cited

U.S. PATENT DOCUMENTS 5,415,134 A * 5/1995 Stewart, Jr. ..... 123/41.01

OTHER PUBLICATIONS

Wsewolod Hnatczuk et al., "Parasitic Loss Reduction for 21st Century Trucks", SAE Technical Paper Series No. 2000-01-3423, Dec. 4-6, 2000.
Matthieu Chanfreau et al., "Advanced Engine Cooling Thermal Management System on a Dual Voltage 42V-14V Minivan", SAE Technical Paper Series No. 2001-01-1742, May 14-17, 2001.
Shinichi Fujii et al., Journal Article Abstract, "Development of High-Efficiency Electric Fuel Pump", SAE Papers, Feb. 1, 2002.
Terufumi Miyazaki et al., Journal Article Abstract, "New Technology of Automatic Transmission for Improving Fuel Economy", SAE Papers, Sep. 1, 2002.
I.S. Larman, "Choosing the Drive System for the Right Application", European Conference on Electrics Versus Hydraulics Versus Pneumatics, ImechE Conference Publications 1985-11, Oct. 22, 1985.
John R. Wagner et al., "Coolant Flow Control Strategies for Automotive Thermal Management Systems", SAE Technical Paper Series No. 2002-01-0713, Mar. 4-7, 2002.
Ski Milburn, "Integration of Advanced Functions into Electric Drivetrains", No. 96C050.
Alexandre Choukroun et al., "Automatic Control of Electronic Actuators for an Optimized Engine Cooling Thermal Management", SAE Technical Paper Series No. 2001-01-1758 (Reprinted from: The Proceedings of the 2001 Vehicle Thermal Managements Systems Conference), May 14-17, 2001.
C. J. Brace et al., "Integrated Cooling Systems for Passenger Vehicles", SAE Technical Paper Series No. 2001-01-1248 (Reprinted from: Thermal Systems Management and Heat Exchangers), Mar. 5-8, 2001.
Valeo, "Engine Cooling: Our Expertise", www.valeo.com/gb/activities/engine_cooling/themis_bene_1.asp, Mar. 17, 2003.
Matthieu Chanfreau et al., "The Need for an Electrical Water Valve in a THErmal Management Intelligent System (THEMIS™)", SAE Technical Paper Series No. 2003-01-0274 (Reprinted from: Thermal Management), Mar. 3-6, 2003.
Joël Maurin et al., "Minipump for Two-Phase Cooling Loop", SAE Technical Paper Series No. 2000-01-2374, Jul. 10-13, 2000.
J. R. Wagner et al., "Thermal Modeling of Engine Components for Temperature Prediction and Fluid Flow Regulation", SAE Technical Papers Series No. 2001-01-1014, Mar. 5-8, 2001.

* cited by examiner

*Primary Examiner*—Tony M. Argenbright
*Assistant Examiner*—Hyder Ali
(74) *Attorney, Agent, or Firm*—Allan J. Lippa; Alleman Hall McCoy Russell & Tuttle LLP

(57) ABSTRACT

An engine cooling system is described that uses the same actuator to adjust both fan speed and coolant pump speed based on operating conditions of the engine and vehicle. The airflow and coolant flow are thus dependent, however, they are independent from engine speed.

22 Claims, 3 Drawing Sheets

CONTROL SYSTEM FOR ENGINE COOLING

BACKGROUND OF THE INVENTION

Engines utilize several methods to control the amount of heat transfer from the engine block to the vehicle surroundings. Engine coolant passes through jackets in the engine to carry heat from combustion to the radiator. At the radiator, heat is transferred to surrounding air. The amount of heat transfer can be adjusted by varying either or both of the amount of airflow across the radiator (e.g., via a fan), and by varying the amount of coolant flow through the engine.

In one example, electronically controlled actuators are used to provide variable airflow (e.g., via a variable speed fan) and variable coolant flow (via a variable speed coolant pump). The two actuators are controlled based on operating conditions in an attempt to provide increased fuel economy and optimal temperature control. Such a system is described in SAE 2001-01-1742.

The inventors herein have recognized a disadvantage with such an approach. Specifically, at least two separate electrical actuators are required to independently control the airflow (e.g., fan) and the coolant flow (e.g., coolant pump). This adds additional cost compared with mechanical engine coolant pumps that are simply driven proportional to engine speed.

Nevertheless, the inventors herein have also recognized that having the ability to control the engine coolant and fan speed independent of engine speed does offer potential fuel economy gains.

SUMMARY OF THE INVENTION

The above disadvantages can be overcome, while at the same time providing improved operation, by a cooling system for an engine comprising:

- an electronically controlled actuator adapted to receive an electrical control signal that varies with operation of the engine;
- a fan mechanically coupled to said actuator, said fan adjusted by said actuator; and
- a coolant adjusting mechanism mechanically coupled to said actuator, said mechanism adjusted by said actuator.

In this way, the same actuator can provide for both airflow and coolant flow adjustment independent of engine speed. Further, since the most power-efficient coolant system uses proportionally related coolant flow and airflow, depending on the system design, it is possible to provide this independent control via the same actuator, thereby reducing system cost.

Note that the actuator can be controlled based on engine operating conditions. Further note that the engine operating condition utilized in the controller can include various parameters, including engine speed, engine load, desired coolant temperature, measured coolant temperature, or combinations thereof.

Note also that additional actuators can be added to the cooling control system if desired.

BRIEF DESCRIPTION OF THE DRAWINGS

The object and advantages of the invention claimed herein will be more readily understood by reading an example of an embodiment in which the invention is used to advantage with reference to the following drawings wherein:

DESCRIPTION OF THE INVENTION

Figure 1A:
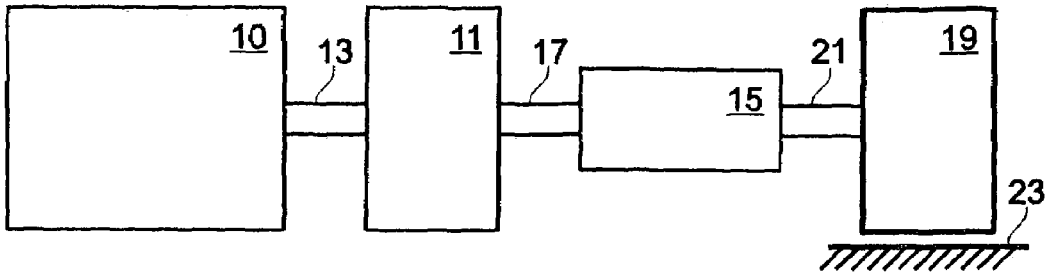
FIG. 1A is a block diagram of a vehicle illustrating various components related to the present invention.
Figure 1B:
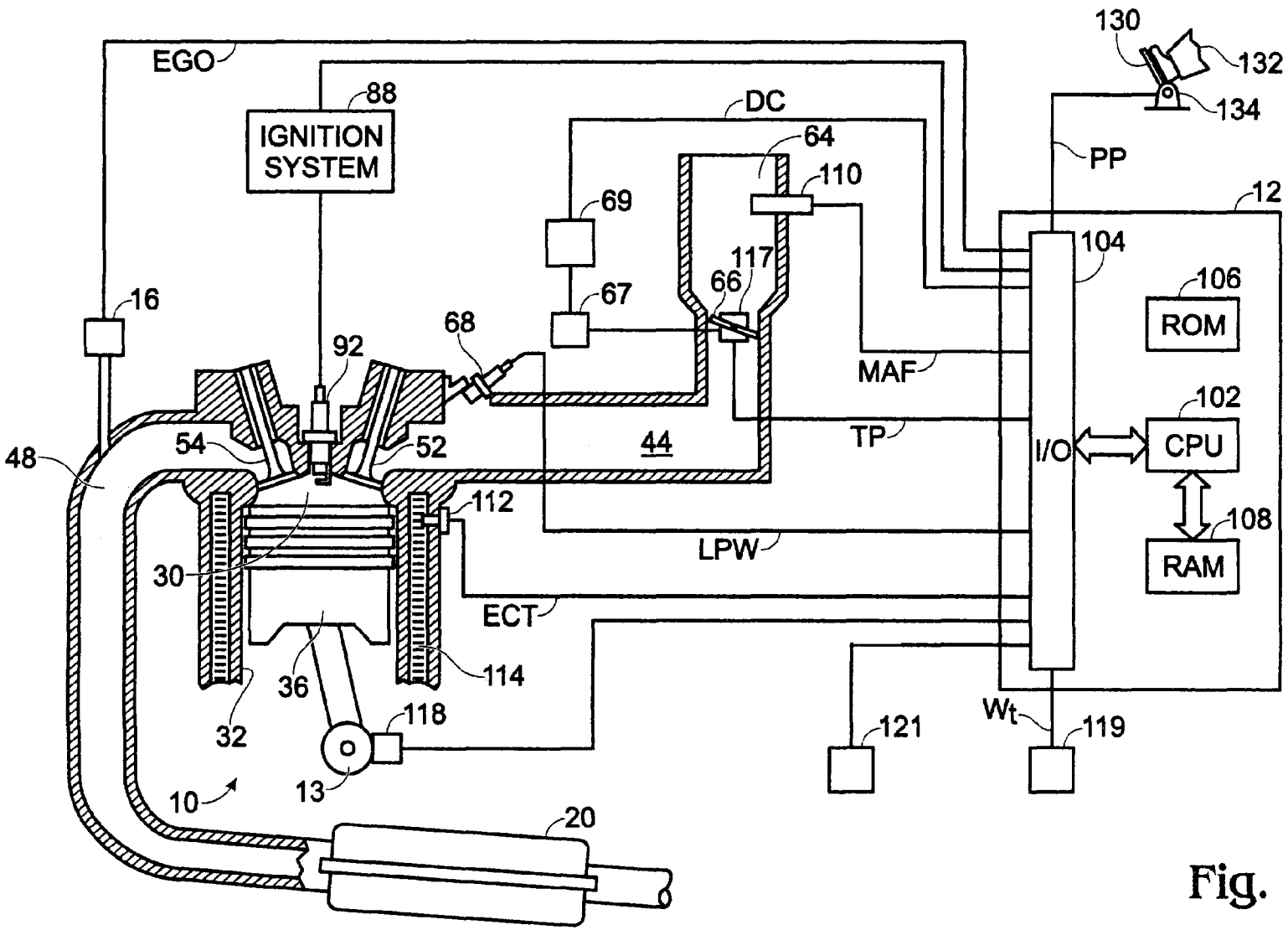
FIG. 1B is a block diagram of an engine in which the invention is used to advantage.

Referring to FIG. 1A, a passenger vehicle powertrain is shown in block diagram format. Internal combustion engine 10, further described herein with particular reference to FIG. 1B, is shown coupled to torque converter 11 via crankshaft 13. Torque converter 11 is also coupled to transmission 15 via turbine shaft 17. Torque converter 11 has a bypass clutch (not shown) which can be engaged, disengaged, or partially engaged. When the clutch is either disengaged or partially engaged, torque converter 11 is said to be in an unlocked state. Turbine shaft 17 is also known as transmission input shaft. Transmission 15 comprises an electronically controlled transmission with a plurality of selectable discrete gear ratios. Transmission 15 also comprises various other gears such as, for example, a final drive ratio (not shown). Transmission 15 is also coupled to tire 19 via axle 21. Tire 19 interfaces the passenger vehicle (not shown) to the road 23.

Internal combustion engine 10 comprising a plurality of cylinders, one cylinder of which is shown in FIG. 1B, is controlled by electronic engine controller 12. Engine 10 includes combustion chamber 30 and cylinder walls 32 with piston 36 positioned therein and connected to crankshaft 13. Combustion chamber 30 communicates with intake manifold 44 and exhaust manifold 48 via respective intake valve 52 and exhaust valve 54. Exhaust gas oxygen sensor 16 is coupled to exhaust manifold 48 of engine 10 upstream of catalytic converter 20. In a preferred embodiment, sensor 16 is a HEGO sensor as is known to those skilled in the art.

Intake manifold 44 communicates with throttle body 64 via throttle plate 66. Throttle plate 66 is controlled by electric motor 67, which receives a signal from ETC driver 69. ETC driver 69 receives control signal (DC) from controller 12. Intake manifold 44 is also shown having fuel injector 68 coupled thereto for delivering fuel in proportion to the pulse width of signal (fpw) from controller 12. Fuel is delivered to fuel injector 68 by a conventional fuel system (not shown) including a fuel tank, fuel pump, and fuel rail (not shown).

Engine 10 further includes conventional distributorless ignition system 88 to provide ignition spark to combustion chamber 30 via spark plug 92 in response to controller 12. In the embodiment described herein, controller 12 is a conventional microcomputer including: microprocessor unit 102, input/output ports 104, electronic memory chip 106, which is an electronically programmable memory in this particular example, random access memory 108, and a conventional data bus.

Controller 12 receives various signals from sensors coupled to engine 10, in addition to those signals previously discussed, including: measurements of inducted mass air flow (MAF) from mass air flow sensor 110 coupled to throttle body 64; engine coolant temperature (ECT) from temperature sensor 112 coupled to cooling jacket 114; a measurement of throttle position (TP) from throttle position sensor 117 coupled to throttle plate 66; a measurement of transmission shaft torque, or engine shaft torque from torque sensor 121, a measurement of turbine speed (Wt) from turbine speed sensor 119, where turbine speed measures the speed of shaft 17, and a profile ignition pickup signal (PIP) from Hall effect sensor 118 coupled to crankshaft 13 indicating an engine speed (We). Alternatively, turbine speed may be determined from vehicle speed and gear ratio.

Continuing with FIG. 1, accelerator pedal 130 is shown communicating with the driver's foot 132. Accelerator pedal position (PP) is measured by pedal position sensor 134 and sent to controller 12.

In an alternative embodiment, where an electronically controlled throttle is not used, an air bypass valve (not shown) can be installed to allow a controlled amount of air to bypass throttle plate 62. In this alternative embodiment, the air bypass valve (not shown) receives a control signal (not shown) from controller 12.

In a preferred embodiment, controller 12 controls engine according to a torque based control system. In such a system, a desired wheel torque, or engine torque, is determined based on pedal position (PP). Then, position of throttle 66 is controlled so that actual wheel torque, or engine torque, approaches the desired engine torque. The system can be configured based on engine brake torque, which is the available torque at the engine output, taking into account torque losses.

Figure 2A:
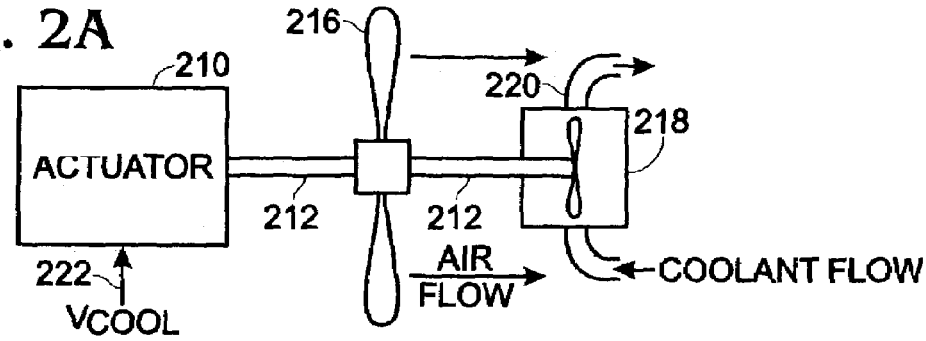
FIGS. 2A, 2B, and 2C are block diagrams of an engine cooling system in which the invention is used to advantage.

Referring now to FIG. 2A, a block diagram of the engine cooling system is shown. Specifically, actuator 210 is shown adjusting both the engine fan 216 and the engine coolant mechanism 218. In one example, actuator 210 is a variable speed actuator which receives a control signal 222 from controller 12. The speed of actuator shaft 212 is governed by the signal 222. Note however, actuator 210 can be of various other types such as, for example: a hydraulic actuator, a pneumatic actuator, an electro-mechanical actuator, an electro-magneto-mechanical actuator, or combinations thereof.

In this particular example illustrated in FIG. 2A, both the airflow actuator 216 and the coolant flow mechanism 218 are mechanically coupled to the actuator's shaft 212. Note that various other mechanical linkages can be used such as, for example: pulleys, gears, clutches, or combinations thereof. For example, if it is desired that the airflow device rotation speed should be at a ratio other than 1:1 of the coolant mechanism rotational speed, a gear or pulley mechanism can be used to couple the airflow and coolant mechanism to actuator 210 with different speed ratios.

Coolant mechanism 218, in this example, is a variable speed pump. Note however, that various other examples can be used, such as, for example: variable displacement pump or a conventional water pump tied to the engine crank shaft utilizing a valve controlled bypass loop. Further, the airflow device 216 is, in this example, a variable speed fan. However, various other devices can be used, such as a variable pitch blade type fan. Thus, in one example, actuator 210 would adjust both fan blade pitch, and valve position of a bypass valve in the coolant flow, thereby adjusting coolant flow recirculation through the coolant system and airflow across the coolant system.

The airflow device 216 adjusts the amount of airflow across the cooling system's radiator, and optionally, the airflow across the engine 10.

In this particular example, the minimum rotational speed of actuator 210 is zero, and thus, even during engine operation, both the fan and coolant pump can be stopped. However, in an alternate embodiment, a minimum speed is required for the system.

Figure 2B:
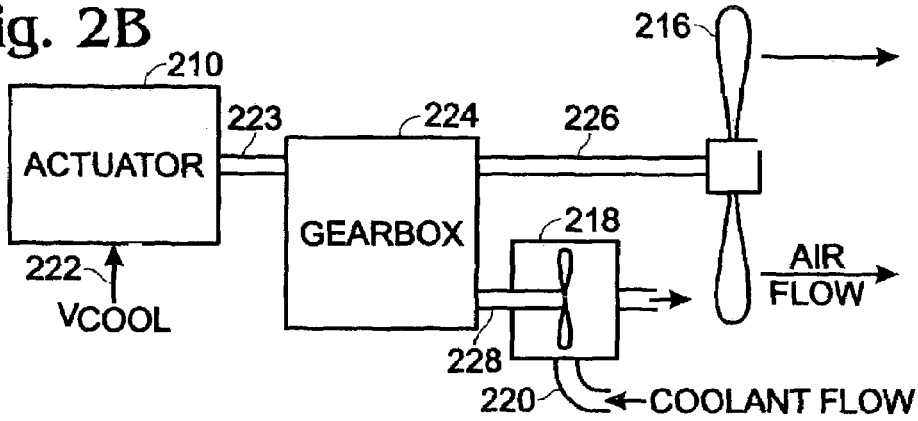

Referring now to FIG. 2B, a block diagram of an alternative engine cooling system is shown. Specifically, actuator 210 is shown adjusting both the engine fan 216 and the engine coolant mechanism 218. In this case, however, a gearbox 224 is coupled to the actuator via shaft 223. The gearbox has two output shafts 226 and 228 that rotate at different speed ratios compared to input shaft 222. The differing gear ratios for the pump and fan are adjusted by, for example, changing the gear sizes and/or number of teeth in the gears inside gearbox 224. In one example, the gear ratios are selected to optimize the efficiency of the combined pump/fan cooling.

Shaft 226 is shown coupled to engine airflow fan 216 and shaft 228 coupled to engine coolant pump 28.

Figure 2C:
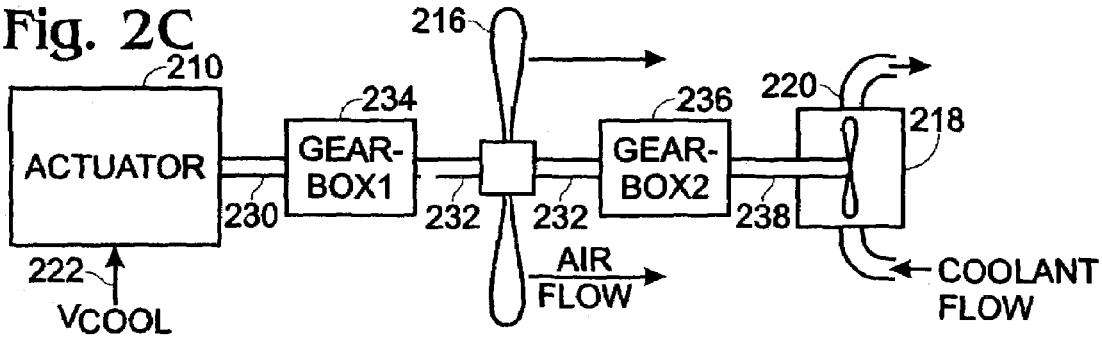

Note that still other system configurations can be used. Such a case is shown in FIG. 2C, where two gearboxes 234 and 236 are used. Specifically, output shaft 230 of actuator 210 is first coupled to fan 216 via a first gearbox 234 and shaft 232. Then, shaft 232 is coupled to shaft 238 and pump 218 via gearbox 236. This also allows the pump and fan to turn at different speed ratios from actuator 230. Still another alternative would be to delete gearbox 1 to allow fan 216 to turn at actuator speed, but retain gearbox 2 to allow the pump to turn at a different speed ratio (either greater or less than 1) from fan 216.

As will be appreciated by one of ordinary skill in the art, the routine(s) described below in the flowchart(s) may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the features and advantages of the invention, but is provided for ease of illustration and description. Although not explicitly illustrated, one of ordinary skill in the art will recognize that one or more of the illustrated steps or functions may be repeatedly performed depending on the particular strategy being used. Further, routines can be implemented via code in a computer readable storage medium.

Figure 3:
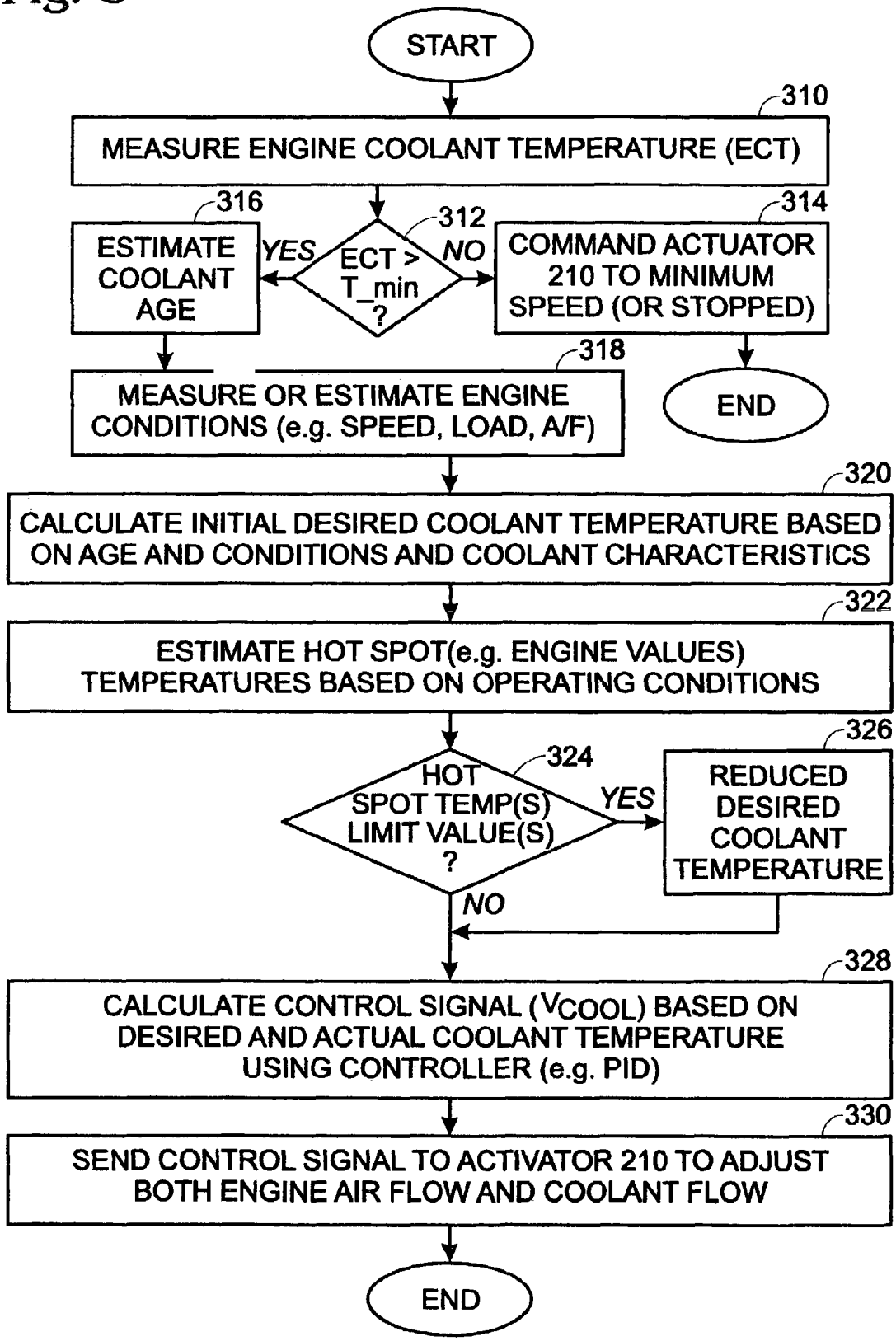
FIG. 3 is a high-level flow chart illustrating operation according to an example embodiment of the invention.

Referring now to FIG. 3, a routine is described for controlling actuator 210. First, in step 310, the routine measured engine coolant temperature (ECT). This can be measured via the sensor 112. Alternatively, multiple temperature sensors can be used to measure coolant temperature. Further still, in another example, engine coolant temperature can be estimated based on various other measured conditions and temperatures. Next, in step 312, the routine determines whether measured engine coolant temperature is greater than a minimum temperature (T_min). When the answer to step 312 is "no", the routine continues to step 314 to command actuator 210 to its minimum speed. If the actuator is capable of being stopped during engine and vehicle operation, in this case the actuator is commanded to be stopped. In this way, rapid engine warm-up can be achieved and minimal coolant heat transfer can be achieved by commanding the actuator to the minimum or stopped speed.

When the answer to step 312 is "yes", the routine continues to step 316. In step 316, the routine estimates engine coolant age. In one approach, the engine coolant age is estimated based on a number of miles traveled by the vehicle and average ambient air temperature experienced by the vehicle during these miles. When the coolant is changed, the vehicle operator can reset the system, thereby allowing the engine coolant age estimate to be updated. Next, in step 318 the routine measures or estimates engine conditions such as, for example: engine speed, engine load, engine air-fuel ratio, and various others. Further, the routine can take into account the mode of engine operation such as simply a lean combustion mode, a stratified combustion mode, or a stoichiometric or rich combustion mode. Then, the routine continues to step 320 to calculate an initial desired coolant temperature based on the coolant age and conditions determined in steps 316 and 318. Further, the routine can take into account engine coolant characteristics in determining the desired coolant temperature.

Next, in step 322, the routine estimates the temperatures of various engine hot spots utilizing engine operating condition information For example, the engine may estimate particular points in the system that can achieve high temperatures during specific operating conditions. In step 324, if any of these hot spot temperatures are greater than a limit value, the routine reduces the desired coolant temperature in step 326 to obtain the final desired coolant temperature.

From either step 326, or a "no" from step 324, the routine continues to step 328. In step 328, the routine calculates a control signal (Vcool) based on the desired coolant temperature (as modified in step 326 if applicable) and the measured, or actual coolant temperature. Specifically, the routine utilizes a PID (proportional-integral-derivative) controller to cause the air between the desired and actual coolant temperature to be reduced. The gains for the PID controller can be tuned and adjusted via engine and vehicle testing.

Finally, in step 330 the routine sends the control signal calculated in step 328 to actuator 210 to adjust both the engine airflow and the coolant flow.

In this way, it is possible to achieve a cost efficient solution to providing independent control of engine airflow and coolant flow from the engine speed of engine 10. This provides more fuel-efficient engine operation, and at the same time, reduces component costs.

I claim:

1. A cooling system for an engine comprising:

an electronically controlled actuator responsive to a control signal;

a variable speed fan coupled to said actuator that adjusts airflow in the engine due to action of said actuator;

a variable speed pump coupled to said actuator that adjusts coolant flow through the engine due to action of said actuator; and a controller for generating said signal based on an engine operating condition, said actuator to adjust said fan and pump throughout the entire range of engine operation.

2. The system of claim 1, wherein said electronically controlled actuator is a hydraulic actuator.

3. The system of claim 1, wherein said electronically controlled actuator is a pneumatic actuator.

4. The system of claim 1, wherein said electronically controlled actuator is an electro-mechanical actuator.

5. The system of claim 1, wherein said electronically controlled actuator is an electro-magneto-mechanical actuator.

6. The system of claim 1, wherein said variable speed fan is mechanically coupled to said actuator with a shaft, a pulley, or a clutch.

7. The system of claim 1, wherein said variable speed fan is a variable pitch blade fan.

8. The system of claim 1, wherein said variable speed pump is mechanically coupled to said actuator with a shaft, a pulley, or a clutch.

9. The system of claim 1, wherein said variable speed pump is a fixed-seed pump having an adjustable by-pass valve.

10. The system of claim 1, wherein said variable speed pump is a variable displacement pump.

11. The system of claim 1, wherein said engine operating condition includes at least engine speed.

12. The system of claim 1, wherein said engine operating condition includes at least engine coolant temperature.

13. A cooling system for an engine comprising:

an electronically controlled actuator adapted to receive an electrical control signal that varies with operation of the engine;

a fan mechanically coupled to said actuator, said fan adjusted by said actuator; and a coolant adjusting mechanism mechanically coupled to said actuator, said mechanism and fan adjusted by said actuator throughout the entire range of engine operation.

14. The system of claim 13, wherein said coolant adjusting mechanism is a variable speed pump.

15. The system of claim 13, wherein said coolant adjusting mechanism is a fixed-seed pump having an adjustable by-pass valve.

16. The system of claim 13, wherein said coolant adjusting mechanism is a variable displacement pump.

17. The system of claim 13, wherein said fan is mechanically coupled to said actuator via a shaft.

18. The system of claim 13, wherein said fan is mechanically coupled to said actuator via a pulley.

19. The system of claim 13, wherein said fan is mechanically coupled to said actuator via a clutch.

20. The system of claim 13, wherein said mechanism is mechanically coupled to said actuator via a shaft.

21. The system of claim 13, wherein said mechanism is mechanically coupled to said actuator via a pulley.

22. The system of claim 13, wherein said mechanism is mechanically coupled to said actuator via a clutch.

* * * * *